United States Patent [19]

Koch et al.

[11] 4,030,332

[45] June 21, 1977

[54] MACHINE FOR STRAIGHTENING ELONGATED WORKPIECES

[75] Inventors: Rolf Eckart Koch, Witzhelden; Ralf Fangmeier, Solingen, both of Germany

[73] Assignee: Kieserling & Albrecht, Solingen, Germany

[22] Filed: June 24, 1976

[21] Appl. No.: 699,641

[30] Foreign Application Priority Data

June 25, 1975 Germany ..... 2528243

[52] U.S. Cl. ..... 72/164; 72/238; 72/234

[51] Int. Cl.[2] ..... B21D 3/02

[58] Field of Search ..... 72/162, 164, 165, 163, 72/234, 235

[56] References Cited

UNITED STATES PATENTS

| | | | |
|---|---|---|---|
| 273,353 | 3/1883 | Frichette | 72/164 |
| 1,959,492 | 5/1934 | Moses | 72/165 |
| 2,411,395 | 11/1946 | Sutton | 72/100 X |
| 3,422,652 | 1/1969 | Lorenz | 72/164 |
| 3,798,948 | 3/1974 | Fangmeier et al. | 72/162 |
| 3,945,234 | 3/1976 | Steinbock | 72/235 |

*Primary Examiner*—Milton S. Mehr
*Attorney, Agent, or Firm*—Michael J. Striker

[57] ABSTRACT

A straightening machine for straightening elongated workpieces at high speed comprises a plurality of stands or frames mounted on a machine bed displaceable with respect to each other in the direction of the movement of the workpieces. Each stand comprises a cage provided with a set of four straightening rolls rotatable about the axis. Each cage is mounted on a cage holder on a guide adjustable in radial direction with respect to the workpiece axis and the guides on the plurality of stands are located in parallel planes normal to the workpiece axis, with the guides on successive stands extending normal to each other as viewed in the direction of movement of the workpiece through the machine.

10 Claims, 4 Drawing Figures

MACHINE FOR STRAIGHTENING ELONGATED WORKPIECES

BACKGROUND OF THE INVENTION

The present invention relates to a straightening machine in which a plurality of frames or stands are mounted on an elongated machine bed displaceable with respect to each other in direction of the movement of the workpieces, and in which each of the stands carries a cage provided with a set of four straightening rolls in which the rolls are mounted for rotation about axes extending normal to the axis of the workpiece.

For straightening workpieces at high speed, in the order of about 1000 meters per minute, only so-called roll straightening machines are usable, since in other known straightening machines, in which either the workpiece rotates or the straightening tools are orbited in a circular path about the workpiece axis, the thereby occurring centrifugal, respectively inertia forces become unacceptably large at the aforementioned speed of travel of the workpieces to be straightened. The known roll straightening machines with two, respectively two times two rows of rolls have, however, the disadvantage that during bending in a second plane the straightening result produced in the preceding plane will be detrimentally affected.

The German Offenbarungsschrift No. 2,126,371, discloses a method in which the workpieces to be straightened are successively bent in directions normal to each other. In this method the workpieces are however bent about their main axes of inertia. This will result in extremely high maximum bending forces. The straightening frames through which the workpieces have to twist are telescopically moved apart. A construction for carrying out the method disclosed in the aforementioned German Auslegesschrift is, however, not disclosed therein. The adjustment of the individual radial displacements of the straightening roll sets in their frames is, during carrying out the disclosed method, extremely difficult. A great number of individual adjustments on the respective straightening frames is necessary whereby the radial adjustments of the individual straightening roll sets and the axial movement of the frames have to be carefully harmonized with each other. Thereby the action of the individual adjustment on one frame is not foreseeable.

The U.S. Pat. No. 2,411,395 discloses a straightening machine for tubes in which three straightening frames are provided. The three frames form together a bending triangle. Each frame carries four rolls constructed and arranged to substantially enclose the tube to be bent. The tube to be bent carries out a spiral movement during the straightening operation. For this reason, the straightening machine disclosed in the U.S. patent is not suitable for a straightening speed of the above-mentioned magnitude. The U.S. discloses already that the straightening frames are preferably adjustable with respect to each other in direction of the movement of the workpiece by means of a double spindle arrangement provided in the machine bed. In this machine there exists also a great number of adjusting possibilities for each straightening frame. The machine disclosed in the aforementioned patent differs however essentially from the machine of the present invention in that the disclosed machine is only suitable for straightening material of circular cross-section.

SUMMARY OF THE INVENTION

It is an object of the present invention to provide an adjusting arrangement for a straightening machine of the above-mentioned kind which is of simple construction and which provides a simple adjustment of the machine which can be observed by a single operator.

With these and other objects in view, which will become apparent as the description proceeds, the straightening machine according to the present invention for elongated workpieces, adapted to move at high speeds through the straightening machine, mainly comprises an elongated machine bed and a plurality of straightening frames of stands mounted on the machine bed displaceable will respect to each other in the direction of movement of the workpieces, in which each of the straightening stands comprises a cage, a roll set having four rolls mounted in the cage with the axis of the rolls extending normal to the axis of the workpiece to be straightened, and a cage holder supporting the cage and displaceably mounted on the machine bed. Guide means are provided on each cage holder for mounting the cage thereon adjustable in the direction of the guide means, in which the guide means on the plurality of stands are located in parallel planes normal to the direction of movement of the workpiece to be straightened, with the guide means of successive stands extending, as viewed in the direction of movement of the workpieces, normal to each other. The number of stands on the machine bed is preferably about ten. The number of adjusting possibilities is, in the machine of the present invention, considerably reduced, without thereby detrimentally influencing the straightening result. At equal cross-sections of the workpieces, the radial adjustment is carried out only once and then not changed any more. The adjustment of the individual bends relative to the absolute dimensions of the workpieces, respectively to the limit of stretchability of the workpiece material, is carried out by moving the stands relative to each other in the longitudinal direction of the machine bed. For this purpose a spline shaft and two threaded spindles, parallel to the direction of movement of the workpieces through the machine, are arranged in the machine bed and gear means, mounted on each of the cage holders for movement therewith and mechanically connected to the spline shaft and the threaded spindles, serve for displacing the stands in longitudinal direction of the spline shaft during rotation of the latter. The gear means of successive cage holders have a different gear ratio. The gear ratios of the gear means on the different cage holders are so dimensioned that the relationship of the distances of the individual stands during axial movement of the same remains unchanged.

Each of the stands of frames comprises a cage and a cage holder. If, as provided in a preferred construction according to the invention, all guides for adjusting the cage relative to the cage holder are inclined under 45° to the vertical, then all cage holders and the cages thereon may be constructed in the same manner, and by reversing successive cage holders through 180°, the above-described arrangement for adjusting successive stands is obtainable. The straightening rolls on each cage are mounted for rotation about vertical, respectively horizontal axes. This arrangement of the straightening rollers and the guides for each cage will result that the workpiece during bending is always pressed into a V-shaped space defined between two straightening rolls. This will result in proper guiding of the workpiece, a relatively large surface at which the workpiece abut onto the straightening rolls producing the bend and, correspondingly, in a relatively small surface pressure during application of the bending force to the workpiece.

All profiles are bent at an angle inclined at 45° to their neutral axis. This will result in equal bending components for correlated bends which are normal to each other. This arrangement serves to simplify and to standardize the adjustment of the straightening machine. The free cross-sectional area formed by the straightening rolls for the passage of the workpiece therethrough may be changed, either by exchange of the straightening rolls, or by appropriate adjusting devices for the individual rolls, to thus be adapted to the cross-section of the workpiece to be straightened. The straightening rolls are preferably mounted in overhung position, which simplifies an exchange of the same. In a construction in which the straightening rolls have to be exchanged, the cage is preferably split in two halves which are connected by a hinge and a hydraulic cylinder. Such a construction makes the straightening rolls mounted in overhung position very easily accessible. Furthermore, in this construction, the straightening rolls which are mounted in one half of the cage may be together adjusted towards the workpiece. This makes it possible, even at small cross-section of the workpieces, to hold the diameter of the straightening rolls rather small, so that, correspondingly, the minimum distance between adjacent stands of the straightening machine can also be held small. Furthermore, in such an arrangement in which the diameter of the rolls need not be changed, the speed at which the workpieces to be straightened are passed through the machine will depend only on the number of revolutions per minute of the motor driving the rolls.

If the rolled profile is of special importance, as for instance for the straightening of workpieces with round or oval cross-section, and therefore the straightening rolls have to be exchanged in accordance with different profiles of the workpiece to be straightened, then the cage should be split, as mentioned before, to be hydraulically opened with all rolls mounted in overhung position in the respective halves of the cage, whereby one pair of straightening rolls in one cage half is simultaneously adjustable toward the other straightening rolls.

For rectangular profiles of the workpieces it is preferred according to the present invention that the straightening rolls are tangential, respectively radial adjustable toward the cross-section of the workpiece, that all rolls are mounted in overhung position and at least in part driven.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
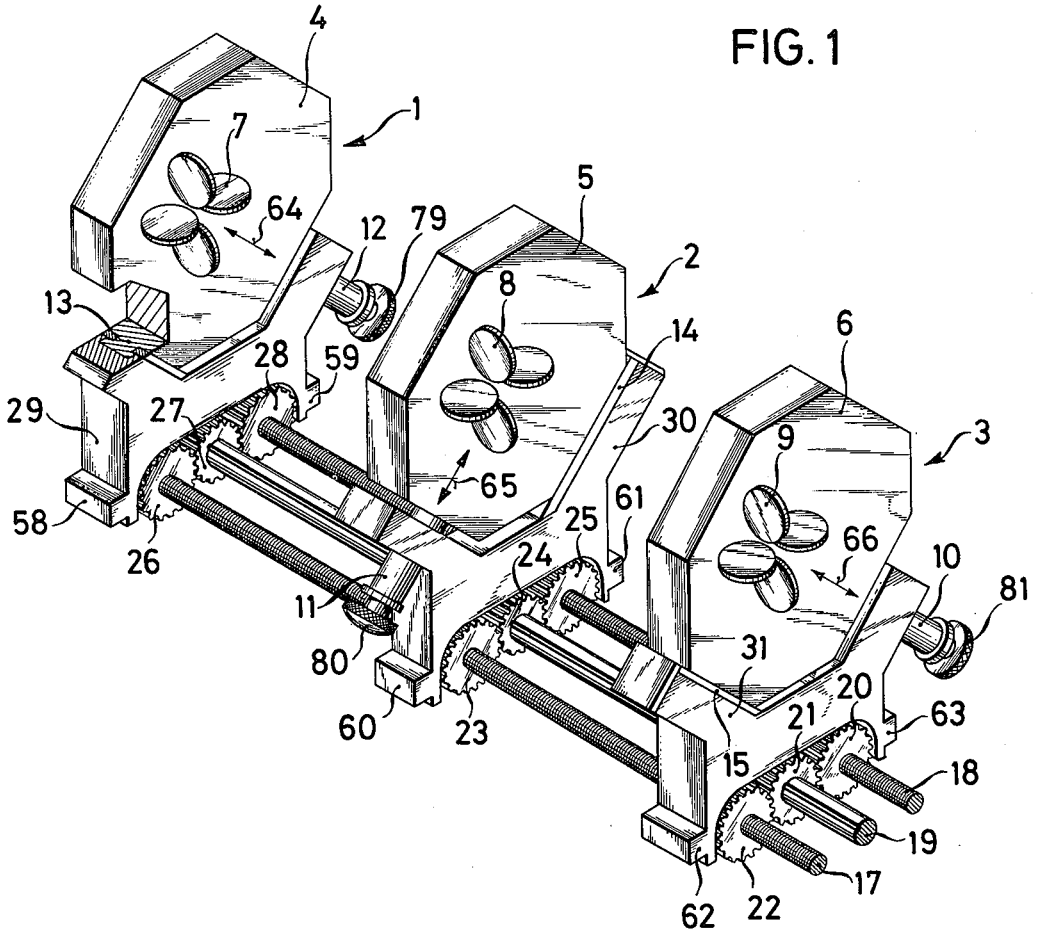
FIG. 1 is a perspective, partial and simplified view of the straightening machine according to the present invention.
Figure 2:
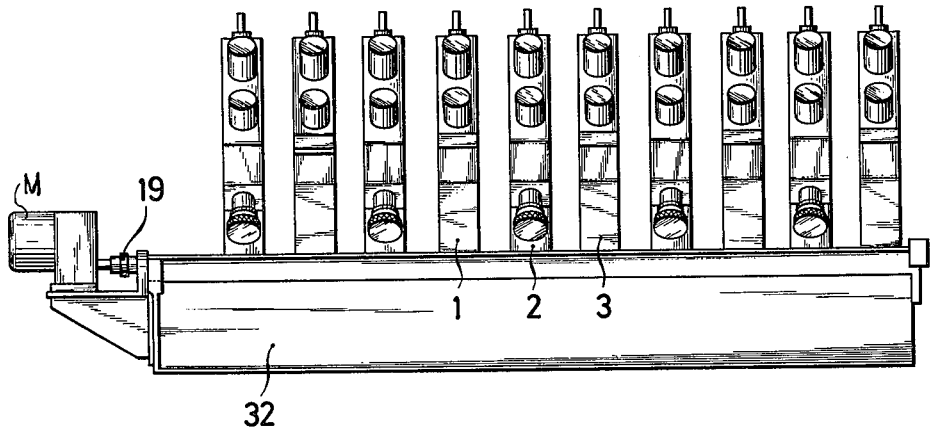
FIG. 2 is a side view of the complete straightening machine drawn to a smaller scale than FIG. 1.

The straightening machine according to the present invention comprises a plurality of stands or frames, of which only the stands 1, 2, and 3 are shown in FIG. 1. The plurality of stands are mounted, as shown in FIG. 2 on an elongated machine bed 32. Each of the stands 1, 2, and 3 comprises a cage, respectively designated with reference numerals 4, 5, and 6 and a cage holder 29, 30 and 31. The cage holders are respectively provided with guide ribs 58, 59; 60, 61; and 62, 63 which are guided in corresponding guide grooves provided in the machine bed. It is to be understood that all the stands shown in FIG. 2 are constructed in the same manner as the stands 1–3 illustrated in FIG. 1. The stands are movable with respect to each other in direction of the elongation of the machine bed 32 by means of two screw spindles 17 and 18 and a spline shaft 19 which are mounted in the machine bed 32. The screw spindles are closely adjacent to the guide ribs 58–63 in order to avoid canting of the stands. The cages 4, 5 and 6 are movable in radial direction relative to the cage holders 29, 30 and 31 with respect to the non-illustrated workpiece. The cages 4, 5 and 6 are movably guided, on the one hand, in flat guides 13, 14 and 15 and, on the other hand, the tubular guides 10, 11 and 12 for movement relative to the cage holders. The tubular guides are adjusted by means of screw spindles 79, 80 and 81, respectively. Each of the screw spindles is threadingly engaged with an inner screw thread provided in a coaxial tube fixed to the respective cage, and an outer tube, guided on the outer surface of the first-mentioned tube, is turnable, but axially immovably connected to the respective screw spindle and fixed to the respective arm of the cage holder, so that during tuning of the screw spindle in one or the other direction, the cages 3, 4 and 5 are moved in the direction of the double-headed arrows 64, 65 and 66, respectively. The flat guides 13–15 and the tubular guides 10–12 extend respectively under an angle of 45° to a perpendicular line. The flat guides of successive stands, as well as the round guides thereof, are respectively normal to each other as viewed in the direction of movement of the workpieces through the machine. Each of the cages 4, 5 and 6 are provided with a roll set respectively numbered 7, 8 and 9 and each comprising four rolls. Two of the four rolls of each set are mounted in the respective cages for rotation about vertical axes and the other two rolls of each set are mounted for rotation about horizontal axes. The axes of all rolls are arranged at a right angle with respect to the central axis of the workpiece passing therebetween.

The dimensions of the stands, in the direction of the elongation of the machine bed 32, is held as small as possible to thus permit a minimum distance between successive stands, so that also workpieces with a small cross-section may be straightened with small bends. Each of the cage holders has two upwardly directed arms which respectively define a V-shaped cutout for the reception of the corresponding cage. The flat guides 13, 14 and 15 are arranged extending along one of the arms of each cage holder, whereas the tubular guides 10–12 extend respectively through the opposite arm. All of the guides are inclined with respect to the axes of the straightening rolls and include, in the illustrated construction, with a vertical line and with the neutral axis of the workpieces, an angle of 45°. The adjustment of the position of the various stands relative to each other in the direction of the elongation of the machine bed 32 is carried out by the screw spindles 17 and 18 and the spline shaft 19. The screw spindles and the spline shaft pass through all of the stands of the machine. The screw spindles 17 and 18 are fixedly mounted in the machine frame 32 and can neither turn nor move in axial direction. The spline shaft 19 is turnably, but axially immovably mounted in the machine frame 32 and may be driven over a coupling 19 from a drive motor M. Gears 21, 24 and 27 are respectively mounted on the spline shaft 19 for the stands 1–3 and of course also for the other stands, not shown in FIG. 1, for turning with the spline shaft and movable in axial direction with respect thereto and these gears mesh respectively with pairs of gears 20, 22; 23, 25 and 26, 28 of the stands 1–3. All gears on the spindles 17 and 18 and on the spline shaft 19 are mounted, in a known manner not illustrated in the drawing, in the respective cage holders turnably about their axes, but axially immovably with regard to the cage holders. During turning of the gears 21, 24 and 27, the gears of each pair of gears respectively meshing therewith are turned in opposite directions. The gears which are mounted on the screw spindles 17 and 18 are provided with an inner screw thread threadingly engaging with the outer screw thread of the axially immovably mounted screw spindles 17 and 18. During turning of the spline shaft 19 and the gears mounted thereon for turning therewith, the stands are thus moved in the direction of the elongation of the machine bed 32. Each of the spindles 17 and 18, which are non-turnable and axially immovably mounted on the machine bed, is provided to opposite sides of its longitudinal center with screw threads convoluted in opposite directions. Furthermore, the gear ratio between the gears mounted on the spline shaft for turning therewith and the pairs of gears on the screw spindles respectively meshing with the central gear in successive stands are so correlated with each other that all stands during turning of the spline shaft are moved toward, respectively away from each other, depending on the direction of rotation of the spline shaft. If an odd number of stands is provided on the machine bed, then it is possible to mount the central stands immovably on the machine bed, and the stands to opposite side of the central stand move then during turning of the spline shaft 19 in the same manner toward or away from the central stand. The proportion of the distances of the stands from each other remains thereby unchanged.

Figure 3:
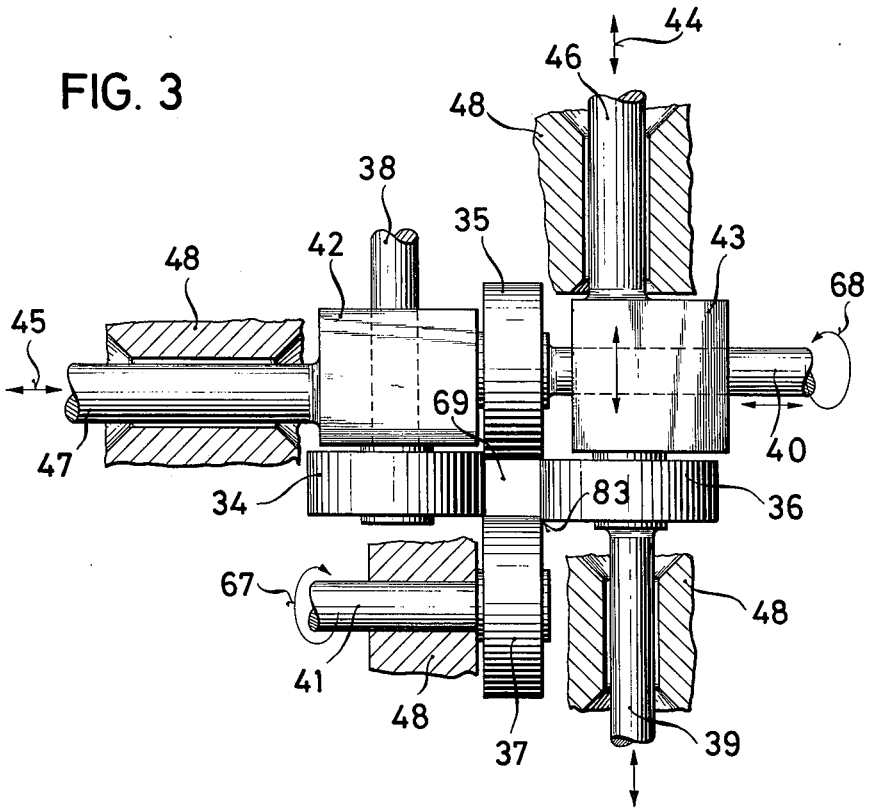
FIG. 3 is a schematic illustration of the adjusting arrangement for the rolls in a cage.

FIG. 3 schematically illustrates part of a cage with four straightening rolls 34, 35, 36 and 37 mounted therein, respectively turnable about vertical and horizontal axes. The straightening rolls 34 and 36 are not driven and they are arranged freely turnable about their axles 38 and 39. The straightening rolls 35 and 37 are driven, in the manner as indicated by the arrows 67 and 68, by drive means known in the art and not forming part of the present invention and therefore not illustrated in FIG. 3. All four straightening rolls are mounted in overhung position. The roll 35 is pressed by a non-illustrated spring against the movable bearing housing 42. The roll 36 is, in a similar manner, pressed by a non-illustrated spring against the movable bearing housing 43. By corresponding adjustment of the push rods 46 and 47, respectively connected to the bearing housing 43 and 42, in the direction of the arrows 44 and 45, the open cross-section 69 for the passage of a workpiece therethrough may be adjusted, within a predetermined limit, to any desired rectangular or quadrangular cross-section. The push rods 46 and 47 are guided for movement in longitudinal direction in the cage 48. The axle 39 for the roll 36 is likewise axially movably mounted in the cage 48. Only the driven shaft 41 is axially immovably mounted in the cage 48. If the open cross-section 69 should be changed to a more slender cross-section, then the push rod 47 is moved in the direction of the arrow 45 towards the right, as viewed in FIG. 3, so that the roll 35 and the shaft 40 connected thereto are likewise moved towards the right. The four straightening rolls form then an upright rectangular profile for the passage of the workpiece. By moving the push rod 46 in downward direction, the open cross-section 69, defined by the four straightening rolls, may be adjusted to a horizontally extending rectangular cross-section for the passage of the workpiece therethrough. During the adjusting movement of the push rod 46, the left end of the shaft 40 slides on the bearing housing 42.

The position of the corner 83 of the open cross-section 69 defined by the four straightening rolls remains unchanged during adjustment of the open cross-section 69.

The not-illustrated workpiece is pressed, during its bending in the open cross-section 69, for instance into the V-shaped section between the peripheral surface of the rolls 36 and 37. The workpiece engages thereby with a relative large surface these straightening rolls. Since the two opposite rolls 35 and 37 can be driven, it is assured that always one of these two rolls over which the workpiece is bent may be driven so that the turning moment imparted thereto will be transmitted to the workpiece to advance the same in longitudinal direction. Depending which way the workpiece is bent, only one of the aforementioned two rolls has to be driven.

Figure 4:
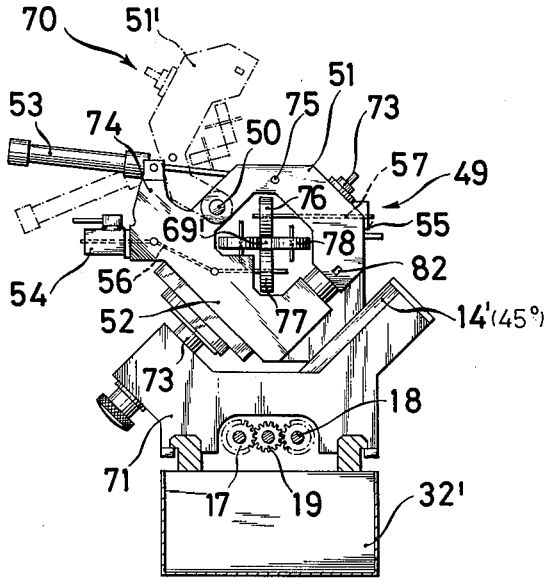
FIG. 4 is a front view of a modified arrangement with a split and hinged cage.

FIG. 4 illustrates an embodiment in which the cage comprises two parts hinged together so as to be movable between an open and a closed position. The stand 49 shown in FIG. 4 comprises a cage holder 71, substantially identical with the cage holders described above, and a cage 70. The stand 49 is guided on guide means in the machine bed 32' for movement in longitudinal direction of the latter. The cage 70 comprises two cage halves 51 and 52 connected at one side by a hinge 50. The cage half 52 is mounted on the cage holder 71 adjustable relative thereto by the tubular guide 73 and the inclined guide 14'. In the embodiment shown in FIG. 4 the positions of the individual rolls are not adjustable relative to each other, but the open cross-section 69', for the passage of the workpiece therethrough, can be changed by exchanging the rolls. In order to use for all rolls the same diameter, the two rolls mounted in the cage half 51 may be adjusted together toward the two rolls in the cage half 52 by means of a common adjusting device 73 of known construction, not forming part of the present invention and therefore only schematically indicated in FIG. 4. The cage half 51 may be moved between an active position, as shown in full lines in FIG. 4, and an inactive position 51', indicated in dotted lines, by a hydraulic cylinder 53 hingedly mounted on a bearing block 74, while the piston rod of the piston in the cylinder 53 is pivotally connected at its free end to the cage half 51 spaced from the hinge 50. In its active or closed position the two halves 51 and 52 of the cage are locked together by a wedge 82, opposite the hinge 50. A drive motor 54 drives the lower roll 77, which is turnable about a horizontal axis, over a Cardan shaft 56. Alternatively, the upper roll 76, opposite the roll 77, may be driven from a motor 55 through a rigid drive shaft 57. The drive motor 55 is, together with the rolls 76 and 78, mounted on the position adjusting mechanism 73 in the cage half 51.

The whole stand 49 is movable in the axial direction of the bed by the spindles 17 and 18 and the spline shaft 19, in the manner as described above.

It will be understood that each of the elements described above, or two or more together, may also find a useful application in other types of machines for straightening elongated workpieces differing from the types described above.

While the invention has been illustrated and described as embodied in a machine for straightening elongated workpieces having a plurality of stands movable on an elongated machine bed toward and away from each other, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. We claim:

1. A straightening machine for elongated workpieces adapted to move at high speed through the straightening machine, comprising an elongated machine bed; and a plurality of straightening stands mounted on said machine bed displaceable with respect to each other in the direction of the elongation of the bed; each of said straightening stands comprises a cage, a roll set having four rolls mounted in the cage with two of the rolls turnable about horizontal axes and two of the rolls turnable about vertical axes, a cage holder supporting the cage and displaceable mounted on the machine bed, guide means on each of the cage holders for mounting the cage thereon adjustable in the direction of said guide means, the guide means on said plurality of cage holders being located in parallel planes normal to the elongation of said bed and the guide means on the cage holders of successive stands extending, as viewed in the direction of movement of the workpieces, normal to each other.

2. A straightening machine as defined in claim 1, wherein each of said guide means includes an angle of 45° with the axes of said rolls.

3. A straightening machine as defined in claim 1, and including a spline shaft and a pair of threaded spindles mounted on said machine bed extending in the direction of the elongation of the latter, and gear means mounted on each of said stands for movement therewith and mechanically connected to said spline shaft and to said threaded spindles for displacing said stands, upon rotation of the spline shaft, in the longitudinal direction of the latter, the gear means on successive stands having a different gear ratio.

4. A straightening machine as defined in claim 3, wherein said threaded spindles are non-rotatable and axially immovably mounted on said machine bed to opposite sides of said spline shaft, and wherein each of said gear means comprises a first gear mounted on said spline shaft for rotation therewith, and two gears respectively mounted on said spindles, each of said two gears having a central bore provided with an inner screw thread meshing with the thread provided on the respective spindle.

5. A straightening machine as defined in claim 4, wherein each of said threaded spindles has a pair of thread portions which, starting from the midpoint between opposite ends of each spindle, are respectively convoluted in opposite directions.

6. A straightening machine as defined in claim 1, and including at least one drive motor for driving at least one roll of each set of rolls.

7. A straightening machine as defined in claim 1, wherein each of said cages comprising two cage halves hingedly connected to each other, one of said cage halves being mounted on said guide means, and the other of said cage halves being movable relative to said one cage half between an inoperative open position and an operative closed position, one pair of rolls of the respective set being mounted in one of said cage halves and movable together toward and away from the pair mounted in the other cage half.

8. A straightening machine as defined in claim 7, and including a shaft for each roll for turnably supporting the same in the respective cage half, said rolls being mounted in overhung position on one end of the respective shaft.

9. A straightening machine as defined in claim 7, and including hydraulic means connected to said other cage half for moving the same between the positions thereof.

10. A straightening machine as defined in claim 1, and including a shaft for each roll for turnably supporting each roll in the respective cage, said rolls being mounted in overhung position on one end of the respective shafts, and wherein only three rolls of each set are adjustable in tangential, respectively in radial direction with respect to the workpiece.

* * * * *